United States Patent [19]

Ischi et al.

[11] Patent Number: 4,675,484

[45] Date of Patent: Jun. 23, 1987

[54] GAS-BLAST CIRCUIT BREAKER

[75] Inventors: Jürg Ischi, Wiler; Andreas Plessl, Niederrohrdorf, both of Switzerland

[73] Assignee: BBC Brown, Boveri & Company, Limited, Baden, Switzerland

[21] Appl. No.: 828,881

[22] Filed: Feb. 13, 1986

[30] Foreign Application Priority Data

Mar. 12, 1985 [CH] Switzerland ..... 1107/85

[51] Int. Cl.[4] ..... H01H 33/12; H01H 33/56

[52] U.S. Cl. ..... 200/146 R; 200/148 R; 200/148 B

[58] Field of Search ..... 200/146 R, 146 A, 148 B, 200/148 R

[56] References Cited

U.S. PATENT DOCUMENTS 2,480,622 8/1949 Warnolk ..... 200/146 R
3,671,696 6/1972 Brunner ..... 200/146 R

FOREIGN PATENT DOCUMENTS 2385212 10/1978 France ..... 200/148 B

*Primary Examiner*—Robert S. Macon
*Attorney, Agent, or Firm*—Burns, Doane, Swecker & Mathis

[57] ABSTRACT

The gas-blast circuit breaker, which is preferably provided for switching medium-high voltages, has two arcing and two rated-current contacts each of which are located in a housing filled with insulating gas and operate in conjunction with each other. For purposes of a compact construction, electric connections, are carried into the interior of the housing transversely to the direction of movement of one moving contact of the two arcing contacts. The driving energy required for a switching process is intended to be kept as low as possible while retaining the compact construction. This is achieved by the fact that the moving rated-current contact is rotatably supported and that a drive, acting on the moving arcing and the moving rated-current contact has two rods which are pivoted at a driving crank, one of which rods is pivoted at the moving arcing contact and the other one of which is pivoted at the moving rated-current contact. In this arrangement, the two insulating rods are pivoted at the driving crank in such a manner that, during the disconnecting process, a thrust crank formed by the driving crank, one rod of insulating material and the moving arcing contact passes through a dead-center position before the disconnected condition has been reached.

4 Claims, 2 Drawing Figures

GAS-BLAST CIRCUIT BREAKER

BACKGROUND OF THE INVENTION

The present invention relates to an improved gas-blast circuit breaker of the type disclosed in Swiss Patent Application 4015/84-0. More particularly, the present invention relates to a circuit breaker having a housing which is filled with insulating gas and in which two contact members are arranged which are moveable relative to each other along an axis and in each case have one arcing and one rated-current contact. In this circuit breaker, the overall length extending in the direction of movement of the contact members is kept small by the fact that electric connections are provided which are carried into the housing transversely to this direction of movement and which form loops in the interior of the housing. However, circuit breakers of this type need a comparatively large driving energy on disconnection since rated-current and arcing contacts are moved at the same time.

BRIEF SUMMARY OF THE INVENTION

The present invention achieves the objective of specifying a gas-blast circuit breaker in which a comparatively small-size drive can be used in spite of a high switching capacity and compact construction.

The gas-blast circuit breaker according to the invention is constructed such that during the disconnecting process the rated-current and its arcing contacts are actuated at staggered time due to the arrangement and construction of its contacts and of its drive and thus a reduction in driving energy is achieved.

BRIEF DESCRIPTION OF THE DRAWING

The objects, features, and advantages of the present invention will become apparent from the following description when read in light of the accompanying drawing, in which.

DETAILED DESCRIPTION OF THE PREFERRED EMBODIMENT

Figure 1:
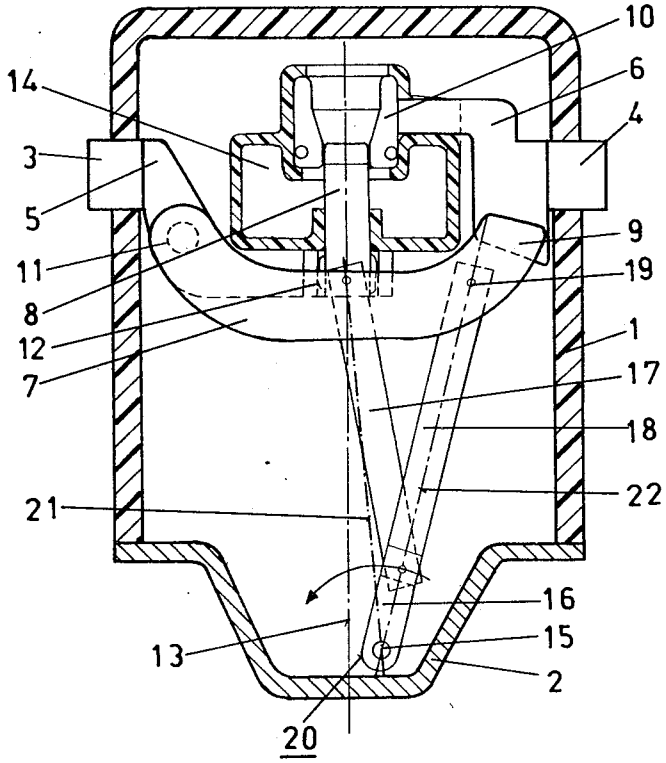
FIG. 1 is a cross-sectional view of a gas-blast circuit breaker according to the present invention in the switched-on position.

Referring to FIG. 1, a housing 1 of insulating material is filled with an insulating gas such as, for example, sulphur hexafluoride at a pressure of 4 to 6 bar, and is closed off by a grounded metal cover 2. At mutually opposite sides of the housing 1, bushings 3 and 4 are provided through which in each case a common electric connection 5 and 6 for a moving rated-current contact 7 and a moving arcing contact 8 or a fixed rated-current contact 9 and a fixed arcing contact 10, respectively, are carried into the interior of the housing 1. The electric connection 5 is electrically conductively connected via a rotating contact 11, which is formed, for example, of laminations, to the moving rated-current contact 7, which is rotatably supported in the electric connection 5, and via a sliding contact 12, which is also formed, for example, of laminations, to the arcing contact 8 which is displaceable along an axis. The fixed rated-current contacted 9 is attached to the electric connection 6. The electric connection 6 is also carried into a switching chamber 14 and electrically conductively connected to the fixed arcing contact 10 located in this switching chamber.

The electric connection 5, together with the support points for the rotating contact 11 and the moving arcing contact 8, is produced from a single pressed copper part. Similarly, the electric connection 6 is also produced from a single pressed copper part. During assembly, the switching chamber 14, which consists of two shells of insulating material and in the insulating material has recesses for accommodating the circuit-breaker contacts and a nozzle of insulating materials through which the arcing contact 8 passes, can then be attached to the two electric connections 5 and 6 by screwing it to these connections.

A driving lever 16, on which two rods of insulating material 17 and 18 are pivoted which are approximately of equal size, is attached to a driving shaft 15 which is rotatably supported in an indention in the earthed metal cover 2 and is carried perpendicularly to the axis 13. The rod 17 of insulating material is pivoted at the end facing away from the fixed arcing contact 10 of the moving arcing contact 8 whereas the rod 18 of insulting material is pivoted in the part facing the fixed rated-current contact 9 of the moving rated-current contact 7.

The moving rated-current contact 7 is formed by a double-bladed contact which consists of two parallel blade contacts of curved construction. The blade-contacts are held at a distance from each other at the rotating contact 11 and at the pivot point 19 and, in the switched-on position, engage the fixed rated-current contact 9 reaching behind the wall of insulating material of the switching chamber 14. There is a sufficient space between the two blade contacts for the electric connection 5 carrying the blade contacts and for an unimpeded sequence of movement of the two rods 17 and 18 of insulating material which are also arranged between the two blade contacts.

A driving crank 20, formed of the driving shaft 15 and the driving lever 16, together with the rod 17 of insulating material and the arcing contact 8 which can be displaced in the direction of the axis 13, forms a thrust crank which is located in a dead-center position 21 along a dot-dashed line. The driving crank 20, the rod 18 of insulating material and the rotating-rated-current contact 7 form a crank-rocker linkage which is in a dead-center position 22 along a further dot-dashed line.

Figure 2:
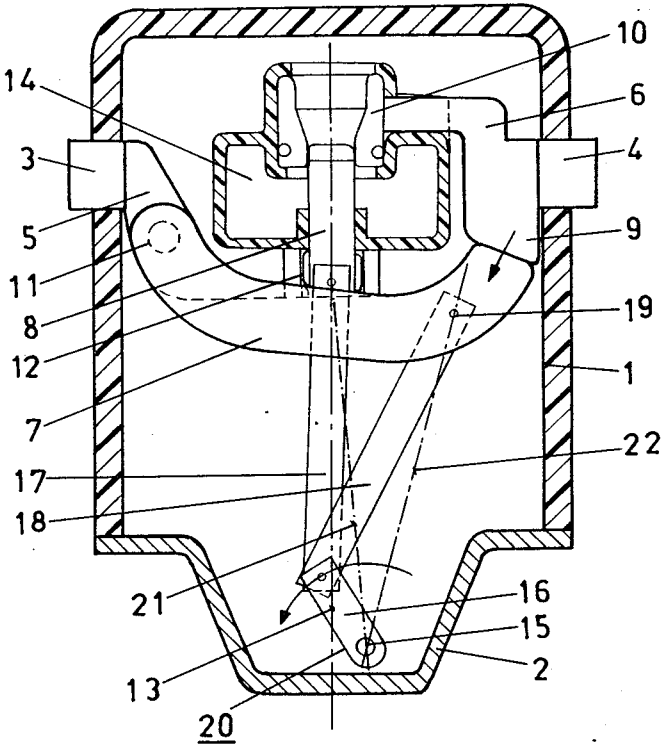
FIG. 2 is a cross-sectional view of the gas-blast circuit breaker shown in FIG. 1 during the disconnection process.

When the gas-blast circuit breaker according to the invention is disconnected, the driving crank 20 is rotated counter-clockwise by a drive, not shown. If the rods 17 and 18 of insulating material are then pivoted at the driving crank 20 in such a manner that, in the switched-on condition, the thrust crank acting on the moving arcing contact 8 is rotated past the dead-center position 21 by an angle of approximately 10° to 30° and the crank-rocker linkage acting on the moving rated-current contact 7 is essentially located in the dead-center position 22, the moving arcing contact 8 moved into the fixed arcing contact 10 in the switched-on condition will change its position only insignificantly for as long as the driving crank 20 reaches the position specified in FIG. 2 only past the dead-center position 21 and the driving shaft 15, in addition, is supported at a distance, which is comparatively short with respect to the length of the rods 17, 18 of insulating material, from the axis 13 in the indentation of the metal cover 2. The crank-rocker linkage located at the dead-center position 22 in the switched-on condition has already moved the moving rated-current contact 7 far enough in the direction of the arrow, up to the time given in FIG. 2, that the rated-current contacts 7 and 9 are beginning to separate and the current to be disconnected, flowing from electric connection 5 via the rotating contact 11, the moving rated-current 7, the fixed rated-current contact 9 to the electric connection 6, commutates to the current path formed by the electric connection 5, the sliding contact 12, the moving arcing contact 8, the fixed arcing contact 10 and the electric connection 6.

With further counter-clockwise rotation of the driving crank 20, the arcing contacts 8, 10 also open and an arc is drawn between the arcing contacts 8, 10 which is subsequently blasted with insulating gas.

An advantage of the gas-blast circuit breaker described above consists in the fact that, due to the suitable arrangement and construction of its contacts and of its drive, a staggering in time of the actuation of its rated-current and its arcing contacts, a reduction in the depth to which the moving arcing contact 8 plunges into the fixed arcing contact 10, and thus considerable saving in driving energy is achieved during the disconnecting process. Simultaneously, the stroke of the moving arcing contact 8 is considerbly reduced since significant movement of this contact in the disconnecting direction can take place only after the rated-current contacts 7, 9 have opened. For this reason, and since, additionally, the moving rated-current contact 7, which is constructed as a curved double blade, reaches behind the switching chamber 14, the gas-blast circuit breaker according to the invention has an extremely compact and space-saving construction. The curved shape of the moving rated-current contact 7, because of the reduction in its predetermined distance from the grounded metal cover 2 in the disconnected condition made possible by this, results not only in saving space but, simultaneously, in achieving reliable insertion and retraction of this contact into and from the fixed rated-current contact 9. Since the moving rated-current contact 7 is essentially moved in the direction of flow of the current to be switched, towards the fixed rated-current contact 9 or away from this contact during the insertion or retraction, interfering transverse forces and tilting moments acting on the moving rated-current contact 7 are eliminated. It is also of advantage that the rated-current contacts 7, 9 are deeply inserted into each other in the switched-on condition which enables good contact to be provided. Since this inserting process is also essentially finished in a dead-center position of the drive, tolerance problems are eliminated.

In variation of the illustrative embodiment described above, it is conceivable to equip the driving crank 20 with two driving levers instead of with one driving lever 16. Each of the two rods 17 and 18 of insulating material can then be pivoted at one of the two driving levers of the driving crank 20. This makes it possible to decouple the sequence of movement of moving rated-current and moving arcing contact even further.

It will be appreciated by those of ordinary skill in the art that the present invention can be embodied in other specific forms without departing from the spirit of essential characteristics thereof. The presently disclosed embodiment is therefore considered in all respects to be illustrative and not restrictive. The scope of the invention is indicated by the appended claims rather than the foregoing description, and all changes that come within the meaning and range of equivalents thereof are intended to be embraced therein.

What is claimed is:

1. Gas-blast circuit breaker comprising (a) a housing which is filled with insulating gas and extends along an axis, (b) two electric connections which are carried into the housing essentially transversely with respect to the axis, (c) a switching chamber which is arranged in the housing, (d) two arcing contacts which are located in the switching chamber and are in each case connected to one of the electric connections, one moving contact of which arcing contacts is displaceable along the axis, (e) two rated-current contacts which are located in the housing and are in each case connected to one of the electric connections, and comprising (f) a drive acting on the moving arcing and the moving rated-current contact, wherein (g) the moving rated-current contact is rotatably supported, (h) the drive has two rods of insulating material which are pivoted at a drive crank and a first of which rods is pivoted at the moving arcing contact and a second of which is pivoted at the moving rated-current contact, and (i)the two rods of insulating material are pivoted at the driving crank in such a manner that, during the disconnecting process, a trust crank formed by the driving crank, the first rod of insulating material and the moving arcing contact passes through a first dead-center position before reaching the disconnected condition, and a crank-rocker linkage formed by the driving crank, the second rod of insultating material and the moving rated-current contact is essentially located in a second dead-center position in the switched-on condition.

2. Gas-blast circuit breaker according to claim 1, wherein (j) the driving crank has a driving lever which is attached to a driving shaft, at which driving lever both rods, of insulating material are jointly pivoted.

3. Gas-blast circuit breaker according to claim 1, wherein (k) the driving crank has two driving levers which are attached to a driving shaft, at which driving levers in each case one of the two rods of insulating material are pivoted.

4. Gas-blast circuit breaker according to one of claims 1 to 3, wherein (l) the pivot point of the moving rated-current contact is attached to a first one of the two electric connections and the fixed rated-current contact is attached to a second one of the two electric connections and wherein (m) the moving rated-current contact is constructed as a curve double blade which reaches behind the switching chamber.

* * * * *